US010329995B1

(12) United States Patent
Larose, Jr. et al.

(10) Patent No.: US 10,329,995 B1
(45) Date of Patent: Jun. 25, 2019

(54) ENGINE AND COOLANT SYSTEM CONTROL SYSTEMS AND METHODS

(71) Applicant: GM Global Technology Operations LLC, Detroit, MI (US)

(72) Inventors: Thomas Larose, Jr., Howell, MI (US); Nicholas Girardi, Milford, MI (US); Douglas C. Sarsen, Hartland, MI (US); Michael A. Smith, Clarkston, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/868,298

(22) Filed: Jan. 11, 2018

(51) Int. Cl.

| | |
|---|---|
| ***F01P 7/16*** | (2006.01) |
| ***F01P 3/20*** | (2006.01) |
| ***F01N 5/02*** | (2006.01) |
| ***F01P 5/12*** | (2006.01) |
| ***F01P 7/04*** | (2006.01) |
| *F01P 7/14* | (2006.01) |
| *F01P 3/00* | (2006.01) |

(52) U.S. Cl.
CPC ..... *F01P 7/165* (2013.01); *F01N 5/02* (2013.01); *F01P 3/20* (2013.01); *F01P 5/12* (2013.01); *F01P 7/04* (2013.01); *F01P 7/164* (2013.01); *F01P 7/167* (2013.01); *F01P 2003/005* (2013.01); *F01P 2005/125* (2013.01); *F01P 2007/146* (2013.01)

(58) Field of Classification Search
CPC ..... F01N 2610/11; F01N 2610/1453; F01N 2900/1821; F01N 2900/1822; F01P 3/16
See application file for complete search history.

(56) References Cited

U.S. PATENT DOCUMENTS

| | | | | |
|---|---|---|---|---|
| 2011/0061374 | A1* | 3/2011 | Noritake | F01N 3/035 60/286 |
| 2012/0186677 | A1* | 7/2012 | Wetzel | B60K 15/03519 137/624.27 |
| 2015/0345432 | A1* | 12/2015 | De La Morena | F02M 26/24 701/102 |
| 2016/0208670 | A1* | 7/2016 | Dylhoff | F01N 11/002 |
| 2016/0326944 | A1* | 11/2016 | Arslanturk | F01P 11/16 |
| 2017/0044951 | A1* | 2/2017 | Bilancia | F01N 9/00 |

* cited by examiner

*Primary Examiner* — Long T Tran

(57) ABSTRACT

A coolant control system of a vehicle includes a coolant pump that pumps coolant to a heat exchanger. A diesel exhaust fluid (DEF) injector injects a DEF into an exhaust system and receives coolant output from the heat exchanger. A fuel heat exchanger transfers heat between coolant and fuel flowing through the fuel heat exchanger. An engine control module is configured to determine a first requested speed for DEF injector cooling, determine a second requested speed for fuel cooling, and based on at least one of the first and second requested speeds, selectively increase at least one of: opening of a valve that controls a flow rate of fuel flowing from the fuel rail to the fuel tank, a flow rate of fuel from fuel injectors of an engine to the fuel tank, and a target speed of the coolant pump.

19 Claims, 6 Drawing Sheets

ENGINE AND COOLANT SYSTEM CONTROL SYSTEMS AND METHODS

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to internal combustion engines and more particularly to coolant and actuator control systems and methods.

An internal combustion engine combusts air and fuel within cylinders to generate drive torque. Combustion of air and fuel also generates heat and exhaust. Exhaust produced by an engine flows through an exhaust system before being expelled to atmosphere.

Excessive heating may shorten the lifetime of the engine, engine components, and/or other components of a vehicle. As such, vehicles that include an internal combustion engine typically include a radiator that is connected to coolant channels within the engine. Engine coolant circulates through the coolant channels and the radiator. The engine coolant absorbs heat from the engine and carries the heat to the radiator. The radiator transfers heat from the engine coolant to air passing the radiator. The cooled engine coolant exiting the radiator is circulated back to the engine to cool the engine.

SUMMARY

In a feature, a coolant control system of a vehicle includes a coolant pump that pumps coolant to a heat exchanger that is different than a radiator of the vehicle. A diesel exhaust fluid (DEF) injector injects a DEF into an exhaust system of the vehicle and receives coolant output from the heat exchanger. A fuel heat exchanger receives fuel flowing from a fuel rail to a fuel tank of the vehicle, receives coolant output from the DEF injector, and transfers heat between coolant flowing through the fuel heat exchanger and fuel flowing through the fuel heat exchanger. The coolant pump receives coolant output from the fuel heat exchanger. An engine control module (ECM) is configured to: determine a first requested speed of the coolant pump for DEF injector cooling; determine a second requested speed of the coolant pump for fuel cooling using the fuel heat exchanger; determine a target speed of the coolant pump based on the first and second requested speeds; control a speed of the coolant pump based on the target speed. Based on at least one of the first requested speed and the second requested speed, selectively increase at least one of: opening of a valve that controls a flow rate of fuel flowing from the fuel rail to the fuel tank; a flow rate of fuel from fuel injectors of an engine to the fuel tank; and the target speed of the coolant pump.

In further features, the ECM is configured to, when the first requested speed is greater than or equal to a predetermined speed, selectively increase the opening of the valve that controls the flow rate of fuel flowing from the fuel rail to the fuel tank.

In further features, the ECM is configured to: determine a predicted value based on a temperature of the fuel; and when the first requested speed is greater than or equal to the predetermined speed and the predicted value is greater than a predetermined value, increase the opening of the valve that controls the flow rate of fuel flowing from the fuel rail to the fuel tank.

In further features, the ECM is configured to: increase the predicted value as the temperature of the fuel decreases; and decrease the predicted value as the temperature of the fuel increases.

In further features, the ECM is configured to, when the first requested speed is greater than or equal to a predetermined speed, selectively increase the flow rate of fuel from fuel injectors of the engine to the fuel tank.

In further features, the ECM is configured to: determine a predicted value based on a temperature of the fuel; and when the first requested speed is greater than or equal to the predetermined speed and the predicted value is greater than a predetermined value, increase the flow rate of fuel from fuel injectors of the engine to the fuel tank.

In further features, the ECM is configured to: increase the predicted value as the temperature of the fuel decreases; and decrease the predicted value as the temperature of the fuel increases.

In further features, the ECM is configured to, when the first requested speed is greater than or equal to a predetermined speed, both: selectively increase the opening of the valve that controls the flow rate of fuel flowing from the fuel rail to the fuel tank; and increase the flow rate of fuel from fuel injectors of the engine to the fuel tank.

In further features, the ECM is configured to: determine a predicted value based on a temperature of the fuel; and when the first requested speed is greater than or equal to the predetermined speed and the predicted value is greater than a predetermined value, both: selectively increase the opening of the valve that controls the flow rate of fuel flowing from the fuel rail to the fuel tank; and increase the flow rate of fuel from fuel injectors of the engine to the fuel tank.

In further features, the ECM is configured to: increase the predicted value as the temperature of the fuel decreases; and decrease the predicted value as the temperature of the fuel increases.

In further features, the ECM is configured to determine the predicted value further based on a vehicle speed, a temperature of the coolant, a flowrate of the coolant, an ambient temperature, and a position of an aerodynamic shutter.

In further features, the ECM is configured to actuate an aerodynamic shutter to an open position when all of: a speed of a fan that pushes air to the heat exchanger and the radiator is less than a predetermined value; a speed of the vehicle is greater than a predetermined value; and the target speed of the coolant pump is equal to a predetermined maximum speed of the coolant pump.

In further features, the ECM is configured to actuate the aerodynamic shutter to a fully closed position when at least one of: the speed of the fan is greater than the predetermined value; and the target speed of the coolant pump is less than the predetermined maximum speed.

In further features, the ECM is configured to selectively set the target speed based on a greater one of the first and second requested speeds.

In further features, the ECM is configured to: determine the first requested speed of the coolant pump based on a temperature of the DEF injector; and determine the second requested speed of the coolant pump based on a temperature of the fuel.

In further features, the ECM is configured to determine the first requested speed of the coolant pump based on a comparison of the temperature of the DEF injector and a vaporization temperature of the DEF.

In further features, the ECM is configured to determine the first requested speed of the coolant pump further based on an amount of heat transfer from the DEF injector to the coolant.

In further features, the ECM is configured to determine the first requested speed of the coolant pump further based on an expected change in an amount of DEF injected by the DEF injector based on an amount of heat transfer between the DEF injector and coolant.

In a feature, a coolant control method of a vehicle includes: by a coolant pump, pumping coolant to a heat exchanger that is different than a radiator of the vehicle; injecting a diesel exhaust fluid (DEF) into an exhaust system of the vehicle by a DEF injector, the DEF injector receiving coolant output from the heat exchanger; by a fuel heat exchanger: receiving fuel flowing from a fuel rail to a fuel tank of the vehicle; receiving coolant output from the DEF injector; and transferring heat between coolant flowing through the fuel heat exchanger and the fuel flowing from the fuel rail to the fuel tank through the fuel heat exchanger, where the coolant pump receives coolant output from the fuel heat exchanger; determining a first requested speed of the coolant pump for DEF injector cooling; determining a second requested speed of the coolant pump for fuel cooling using the fuel heat exchanger; determining a target speed of the coolant pump based on the first and second requested speeds; controlling a speed of the coolant pump based on the target speed; and based on at least one of the first requested speed and the second requested speed, selectively increasing at least one of: opening of a valve that controls a flow rate of fuel flowing from the fuel rail to the fuel tank; a flow rate of fuel from fuel injectors of an engine to the fuel tank; and the target speed of the coolant pump.

In a feature, a method of controlling coolant flow by an engine control module includes: determining a first requested speed of a coolant pump for diesel exhaust fluid (DEF) injector cooling based on one or more operating parameters; determining a second requested speed of the coolant pump for fuel cooling using a fuel heat exchanger based on the one or more operating parameters; determining a target speed of the coolant pump based on a greater one of the first and second requested speeds; controlling a speed of the coolant pump based on the target speed; determining a predicted value based on a temperature of the fuel; and when the first requested speed is greater than or equal to a predetermined speed and the predicted value is greater than a predetermined value, both: selectively increasing an opening of a valve that controls a flow rate of fuel flowing from a fuel rail to a fuel tank; and increasing a flow rate of fuel from fuel injectors of an engine to the fuel tank.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
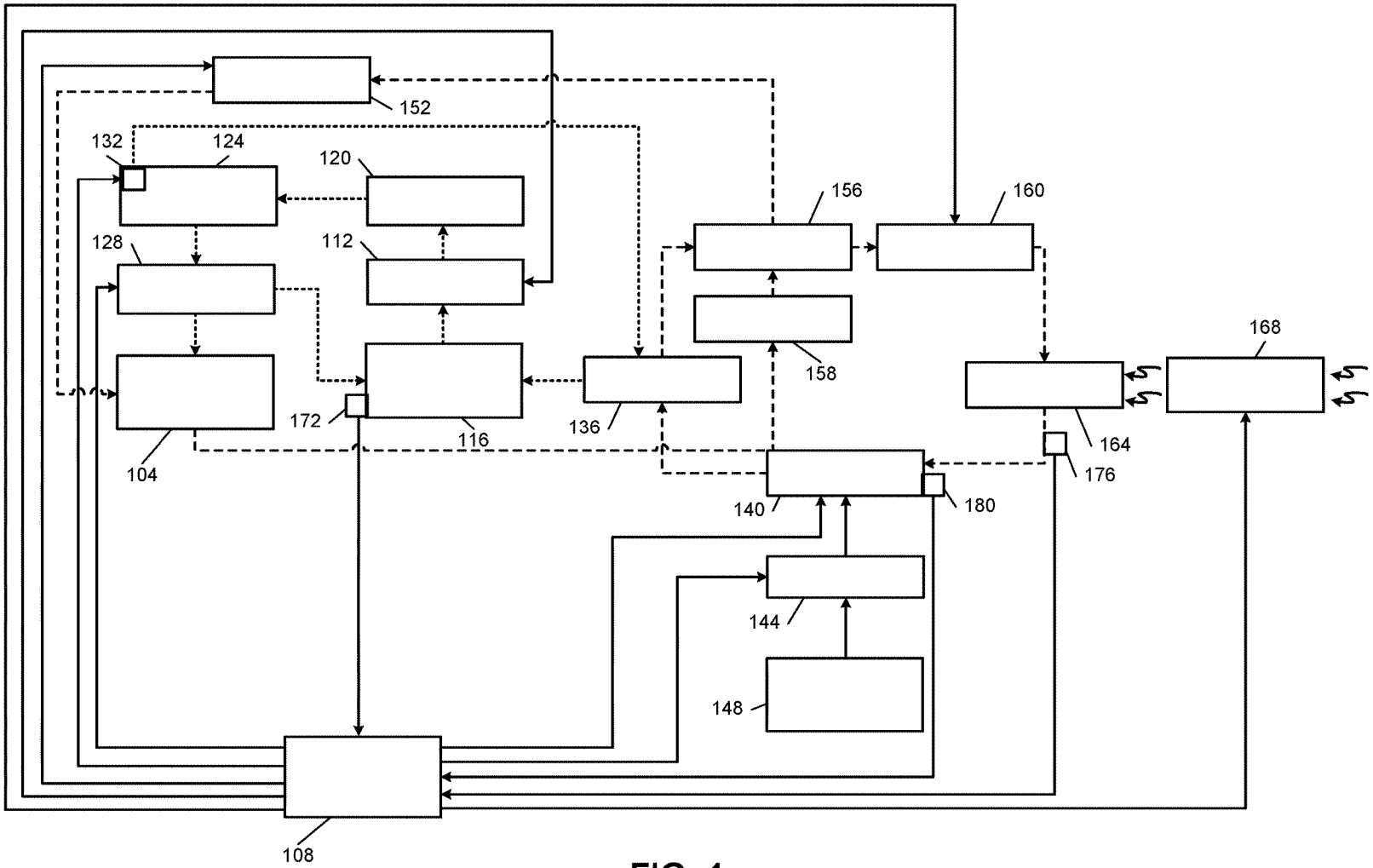
FIG. 1 is a functional block diagram of an example vehicle system including an engine system and a coolant system.

An engine combusts air and fuel to generate drive torque. For example, a diesel engine combusts air and diesel fuel within cylinders to generate drive torque. Combustion of air and fuel also generates heat and exhaust. Exhaust produced by the engine flows through an exhaust system before being expelled to atmosphere.

A diesel exhaust fluid (DEF) injector injects a DEF (e.g., urea) into the exhaust system to reduce the amount of one or more exhaust components (e.g., Nitrogen Oxides) before the exhaust is expelled to atmosphere.

A low pressure fuel pump pumps fuel from a fuel tank to a high pressure fuel pump. The high pressure fuel pump pumps fuel to a fuel rail. Fuel injectors inject fuel into cylinders of the engine from the fuel rail. A fuel regulator valve regulates fuel flow from the fuel rail back to the fuel tank. Fuel may also return to the fuel tank from the fuel injectors when insufficient power to open the fuel injectors is applied to the fuel injectors.

A coolant system circulates coolant through various components of the vehicle. For example, the coolant system includes a first coolant pump that pumps coolant through the engine, a radiator, and one or more other components, for example, to cool the engine and the one or more other components. The coolant system also includes a second coolant pump that pumps coolant through a heat exchanger, the DEF injector, and a fuel heat exchanger. Fuel flowing from the fuel rail back to the fuel tank (via opening of the fuel regulator valve) flows through the fuel heat exchanger on its way from the fuel rail to the fuel tank.

The heat exchanger transfers heat from coolant flowing through the heat exchanger to air passing the heat exchanger. Coolant flows from a coolant reservoir, through the heat exchanger to the DEF injector. Coolant flowing past/through the DEF injector draws heat from the DEF injector. The DEF injector is heated via the exhaust and the exhaust system. Coolant flows from the DEF injector, through the fuel heat exchanger, back to the coolant reservoir. Coolant flowing through the fuel heat exchanger transfers heat to and from fuel flowing from the fuel rail, through the fuel heat exchanger, to the fuel tank.

Under some circumstances, cooling of the DEF injector may be requested when cooling of fuel may cause gelling of the fuel. Under other circumstances, cooling of the DEF injector may be needed to prevent DEF from boiling within the DEF injector. Boiling of DEF may cause crystallization and clogging of the DEF injector. Under some circumstances, cooling of the fuel may be requested when cooling of the DEF injector may cause loss of DEF vaporization.

According to the present disclosure, a control module (e.g., an engine control module) may control fuel flow from the fuel injectors and/or the fuel rail to warm the fuel and prevent gelling. Additionally or alternatively, the control module may control a speed of the second coolant pump based on a fuel temperature to prevent gelling of the fuel. Additionally or alternatively, the control module may control a speed of the second coolant pump based on a temperature of the DEF injector to prevent DEF boiling and overcooling of the DEF injector. The DEF may not fully vaporize if the DEF injector is overcooled. Additionally or alternatively, when the second coolant pump is operating at a predetermined maximum speed (e.g., for DEF injector cooling and/or fuel cooling), the control module may open aerodynamic shutters. Opening the aerodynamic shutters may allow airflow past the heat exchanger and provide increased cooling of the coolant. The aerodynamic shutters block ambient airflow into an engine compartment when the aerodynamic shutters are closed.

Referring now to FIG. 1, a functional block diagram of an example vehicle system including an engine system and a coolant circuit is presented. Solid lines in FIG. 1 are representative of electrical signals. Dashed lines are representative of coolant flow. Dotted lines are representative of fuel flow.

A vehicle includes a low pressure pump 112 that draws diesel fuel from a fuel tank 116 and pumps fuel to a high pressure pump 120 based on a first target pressure. The low pressure pump 112 may be an electric fuel pump. Alternatively, the low pressure pump 112 may be mechanically driven (e.g., by an engine 104). The low pressure pump 112 may be located inside or outside the fuel tank 116.

The high pressure pump 120 pumps to a fuel rail 124 based on a second target pressure that is greater than the first target pressure. The high pressure pump 120 may be mechanically driven (e.g., by the engine 104). Alternatively, the high pressure pump 120 may be an electric fuel pump.

Fuel injectors 128 are coupled to the fuel rail 124 and inject fuel from the fuel rail 124 directly into cylinders of the engine 104. For example, one or more fuel injectors may be provided per cylinder of the engine 104. Combustion of air and fuel within the cylinders generates drive torque. Combustion of air and fuel results in exhaust that is expelled from the cylinders to an exhaust system before being expelled to atmosphere.

A regulator valve 132 regulates fuel flow from the fuel rail 124 back to the fuel tank 116. More specifically, fuel flows from the fuel rail 124 to a fuel heat exchanger 136 and from the fuel heat exchanger 136 to the fuel tank 116. Generally, the fuel heat exchanger 136 transfers heat from fuel flowing through the fuel heat exchanger 136 to coolant flowing through the fuel heat exchanger 136 to cool fuel flowing back to the fuel tank 116.

Fuel may also flow from the fuel injectors 128 back to the fuel tank 116 under some circumstances. For example, a fuel injector opens when at least a predetermined power (e.g., voltage or current) is applied for a predetermined period to the fuel injectors 128. Fuel may flow from the fuel injector back to the fuel tank when the predetermined power is applied for a period less than the predetermined period to open the fuel injector.

The engine 104 combusts a mixture of air and fuel within cylinders to generate drive torque. The engine 104 outputs torque to a transmission. The transmission transfers torque to one or more wheels of a vehicle via a driveline (not shown). An engine control module (ECM) 108 may control one or more engine actuators to regulate the torque output of the engine 104, for example, based on a target torque output of the engine 104. Examples of engine actuators include, for example, the fuel injectors 128, a throttle valve, one or more turbochargers, intake and/or exhaust valve actuators, camshaft phasers, and other engine actuators.

A diesel exhaust fluid (DEF) injector 140 injects DEF (e.g., urea) into the exhaust system upstream of a catalyst, such as a selective catalytic reduction (SCR) catalyst. Ammonia from the DEF is stored by the catalyst. Ammonia reacts with Nitrogen Oxides (NOx) passing the catalyst, thereby reducing NOx output from the exhaust system.

A DEF pump 144 draws DEF from a DEF tank 148 and pumps DEF to the DEF injector 140. The DEF pump 144 may be an electric DEF pump. The ECM 108 may control the DEF pump 144, for example, based on a target pressure of DEF to the DEF injector 140.

Combustion of air and fuel within the engine 104 generates heat. The engine 104 includes a plurality of coolant channels through which engine coolant ("coolant") flows. For example, the engine 104 includes coolant channels through a (cylinder) head portion of the engine 104 and coolant channels through a block portion of the engine 104. The engine 104 may also include one or more other coolant channels through one or more other portions of the engine 104.

A first coolant pump 152 draws coolant from a coolant reservoir 156, such as a first portion of a coolant surge tank, and pumps coolant to the coolant channels of the engine 104. Coolant flowing through the engine 104 absorbs heat from the engine 104. Coolant flows from the engine 104 to a radiator (i.e., a heat exchanger) 158. The radiator 158 transfers heat from coolant flowing through the radiator 158 to air passing around and through the radiator 158. The first coolant pump 152 pumps (cooled) coolant from the radiator 158 to the engine 104. The first coolant pump 152 may be, for example, an electric coolant pump.

A second coolant pump 160 draws coolant from the coolant reservoir 156, such as a second portion of the coolant surge tank, and pumps coolant to a heat exchanger 164 (a secondary heat exchanger). The second coolant pump 160 may be an electric coolant pump. The heat exchanger 164 transfers heat from coolant passing through the heat exchanger 164 to air passing around and through the heat exchanger 164.

One or more fans may push air around and through the radiator 158 and the heat exchanger 164 when the one or more fans are on. An aerodynamic shutter 168 regulates ambient airflow through a grille of the vehicle to the heat exchanger 164 and the radiator 158. More specifically, the aerodynamic shutter 168 allows ambient airflow from the grille to the heat exchanger 164 and the radiator 158 when the aerodynamic shutter 168 is open. The aerodynamic shutter 168 blocks ambient airflow through the grille to the heat exchanger 164 and the radiator 158 when the aerodynamic shutter 168 is closed. While the example of one aerodynamic shutter is shown and discussed, the present application is also applicable to implementations including two or more aerodynamic shutters.

The DEF injector 140 receives coolant output from the heat exchanger 164. Operation of the DEF injector 140 generates heat. Heat from the DEF injector 140 may transfer to the coolant flowing through the DEF injector 140. Coolant flowing through or past the DEF injector 140 cools the DEF injector 140 and DEF within the DEF injector 140. Coolant flows from the DEF injector 140 to the fuel heat exchanger 136. The fuel heat exchanger 136 may also be referred to as a fuel cooler.

The fuel heat exchanger 136 transfers heat between coolant flowing through the fuel heat exchanger 136 and fuel flowing through the fuel heat exchanger 136. For example, coolant flowing through the fuel heat exchanger 136 may cool fuel flowing through the fuel heat exchanger 136 when the fuel flowing through the fuel heat exchanger 136 is hot. As another example, coolant flowing through the fuel heat exchanger 136 may warm fuel flowing through the fuel heat exchanger 136 to prevent fuel gelling when the fuel is cold. Coolant output from the fuel heat exchanger 136 may flow to the coolant reservoir 156 or the second coolant pump 160. In various implementations, fuel flowing from the fuel injectors 128 back to the fuel tank 116 may also flow through the fuel heat exchanger 136 en route to the fuel tank 116.

The coolant reservoir 156, the second coolant pump 160, the heat exchanger 164, the DEF injector 140, and the fuel heat exchanger 136 form a coolant circuit. The second coolant pump 160 controls a flow rate of coolant through the coolant circuit.

A fuel temperature sensor 172 measures a temperature of the fuel in the fuel tank 116. For example, the fuel temperature sensor 172 may be located between the fuel tank 116 and the high pressure pump 120. Alternatively, the fuel temperature sensor 172, for example, may be located within the fuel rail 124.

A coolant temperature sensor 176 measures a temperature of coolant output from the heat exchanger 164 (to the DEF injector 140). A DEF injector temperature sensor 180 may measure a temperature of the DEF injector 140. In various implementations, the temperature of the DEF injector 140 may be estimated by the ECM 108 based on one or more other parameters. One or more other sensors may also be implemented, such as an ambient temperature sensor, one or more engine temperature sensors, an aerodynamic shutter position sensor, and/or one or more other suitable vehicle sensors.

Figure 2:
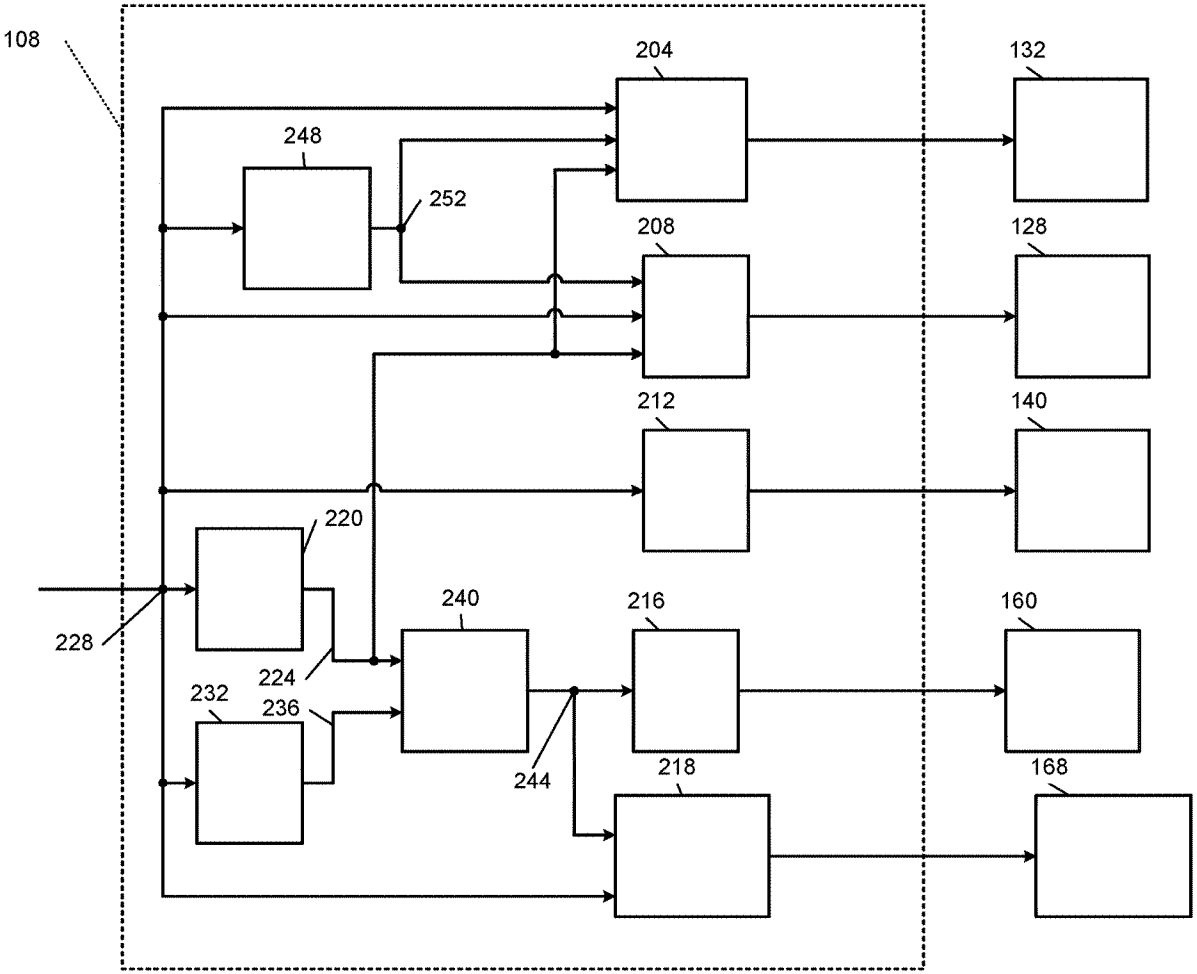
FIG. 2 is a functional block diagram of an example engine control module.

Referring now to FIG. 2, a functional block diagram of an example implementation of the ECM 108 is presented. A regulator control module 204 controls opening of the regulator valve 132. As discussed above, the regulator valve 132 controls fuel flow from the fuel rail 124 to the fuel tank 116.

A fuel control module 208 controls the fuel injectors 128 to control fuel injection by the fuel injectors 128 and fuel flow from the fuel injectors 128 back to the fuel tank 116. For example, the fuel control module 208 may apply a predetermined voltage to a fuel injector to open the fuel injector and inject fuel. The fuel control module 208 may not apply power to the fuel injector to close the fuel injector. The fuel control module 208 may apply a voltage for a period that is less than the predetermined period to open the fuel injector and greater than zero to cause the fuel injector to output fuel from the fuel rail 124 back to the fuel tank 116.

A DEF control module 212 controls DEF injection by the DEF injector 140. For example, the DEF control module 212 may apply a predetermined voltage to the DEF injector 140 to open the DEF injector 140. The DEF injector 140 injects DEF into the exhaust system when the DEF injector 140 is open. The DEF control module 212 may not apply power to the DEF injector 140 to close the DEF injector 140. The DEF control module 212 may generally control opening of the DEF injector 140 to achieve a target DEF flow rate into the exhaust system.

A coolant control module 216 controls operation and output (e.g., displacement and/or speed) of the second coolant pump 160. The coolant control module 216 may control application of power to the second coolant pump 160 to control operation and output of the second coolant pump 160. A shutter control module 218 controls a position of the aerodynamic shutter 168. The position may be a fully open position (e.g., 100 percent open), a fully closed position (e.g., 0 percent open), or a position between the fully open position and the fully closed position.

A first request module 220 determines a first requested speed 224 of the second coolant pump 160 based on one or more operating parameters 228, such as a temperature of the DEF injector 140. The first request module 220 determines the first requested speed 224 using a lookup table or an equation that relates DEF injector temperatures to first requested speeds of the second coolant pump 160. For example, the first request module 220 may increase the first requested speed 224 as the temperature of the DEF injector 140 increases and vice versa. The first requested speed 224 corresponds to a speed of the second coolant pump 160 for cooling of the DEF injector 140. Cooling of the DEF injector 140 may increase as the speed of the second coolant pump 160 increases and vice versa. The temperature of the DEF injector 140 may be measured, for example, using the DEF injector temperature sensor 180 or estimated based on one or more of the operating parameters 228.

A second request module 232 determines a second requested speed 236 of the second coolant pump 160 based on one or more of the operating parameters 228, such as a temperature of the fuel. The second request module 232 determines the second requested speed 236 using a lookup table or an equation that relates fuel temperatures to second requested speeds of the second coolant pump 160. For example, the second request module 232 may increase the second requested speed 236 as the fuel temperature increases and vice versa. The second requested speed 236 corresponds to a speed of the second coolant pump 160 for cooling of the fuel flowing to the fuel tank 116. Cooling of the fuel may increase as the speed of the second coolant pump 160 increases and vice versa. The fuel temperature may be measured, for example, using the fuel temperature sensor 172 or estimated based on one or more of the operating parameters 228. The coolant temperature may be measured, for example, using the coolant temperature sensor 176 or estimated based on one or more of the operating parameters 228.

A target module 240 determines a target speed 244 of the second coolant pump 160. For example, the target module 240 determines the target speed 244 based on the first and second requested speeds 224 and 236. For example, the target module 240 may set the target speed 244 based on or equal to the greater (maximum) one of the first and second requested speeds 224 and 236. The coolant control module 216 operates the second coolant pump 160 at the target speed 244.

In various implementations, the target module 240 may adjust the target speed 244 based on one or more of the operating parameters 228. For example, the target module 240 may determine a first correction value based on a fuel flow rate through the fuel heat exchanger 136, a fuel cooling effectiveness value, a DEF injection flow rate, and a DEF cooling effectiveness value. The target module 240 may determine the fuel cooling effectiveness value as a function of a coolant temperature within the coolant circuit and the fuel temperature. The target module 240 may determine the DEF cooling effectiveness value as a function of the DEF injector temperature and the coolant temperature. The target module 240 may determine the first correction value using one or more equations and/or lookup tables that relate fuel flow rates, fuel cooling effectiveness values, DEF injection flow rates, and DEF cooling effectiveness values to first correction values.

The target module 240 may determine a second correction value based on an ambient temperature, a vehicle speed, an aerodynamic shutter position, and a speed of the one or more fans. The target module 240 may determine the second correction value using one or more equations and/or lookup tables that relate ambient temperatures, vehicle speeds, aerodynamic shutter positions, and fan speeds to second correction values. The target module 240 may adjust the target speed based on the first and second correction values, for example, by multiplying the target speed by the first and second correction values or adding the first and second correction values to the target speed.

Figure 3:
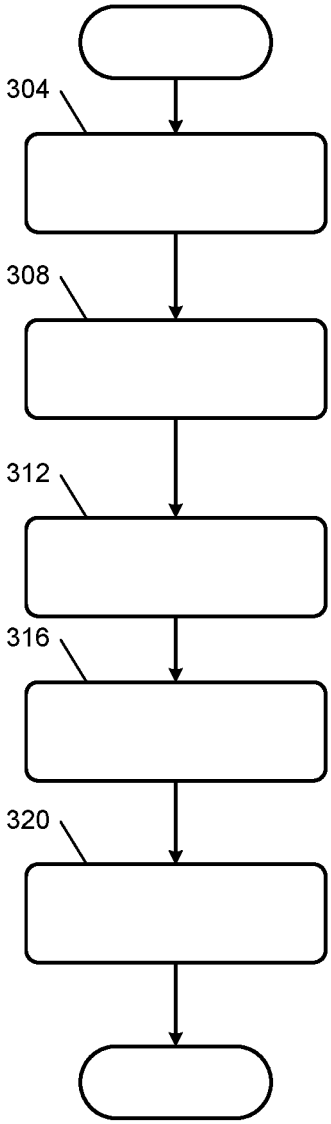
FIG. 3 is a flowchart depicting an example method of controlling coolant flow.

FIG. 3 is a flowchart depicting an example method of controlling the speed of the second coolant pump 160. Control begins with 304 where the first and second request modules 220 and 232 determine the first and second requested speeds 224 and 236, respectively. At 308, the target module 240 determines the target speed 244 based on the first and second requested speeds 224.

At 312, the target module 240 may determine the first and second correction values. The target module 240 may adjust the target speed 244 based on the first and second correction values at 316. At 320, the coolant control module 216 controls the speed of the second coolant pump 160 based on the target speed 244. While control is shown and discussed as ending, the example of FIG. 3 may be illustrative of one control loop and control may return to 304.

Referring back to FIG. 2, a prediction module 248 determines a predicted value 252 based on one or more of the operating parameters 228, such as the fuel temperature, a rate of change of the fuel temperature, the vehicle speed, the ambient temperature, the position of the aerodynamic shutter 168, the coolant temperature within the coolant circuit, and a flow rate of coolant through the coolant circuit. The prediction module 248 may determine the predicted value 252 using one or more lookup tables and/or equations that relate the plurality of the operating parameters 228 to predicted values. The predicted value 252 corresponds to a likelihood of occurrence of unnecessary fuel cooling under the operating parameters. The predicted value 252 may increase as the likelihood increases and vice versa. Unnecessary fuel cooling may cause fuel gelling.

When the first requested speed 224 is greater than a predetermined speed (indicative of a request for cooling of the DEF injector 140) and the predicted value 252 is greater than a predetermined value, one or more remedial actions may be taken to prevent fuel gelling. For example, the regulator control module 204 may increase opening of the regulator valve 132. Increasing the opening of the regulator valve 132 increases a flow rate of warm fuel from the fuel rail 124 back to the fuel tank 116. This may help prevent fuel gelling. Additionally or alternatively, the fuel control module 208 may increase a period of application of a voltage to the fuel injectors 128 that is a period less than the predetermined period to open the fuel injectors 128 and greater than zero. This causes the fuel injectors 128 to increase a flow rate of warm fuel from the fuel injectors 128 (and the fuel rail 124) back to the fuel tank 116. This too may help prevent fuel gelling.

Figure 4:
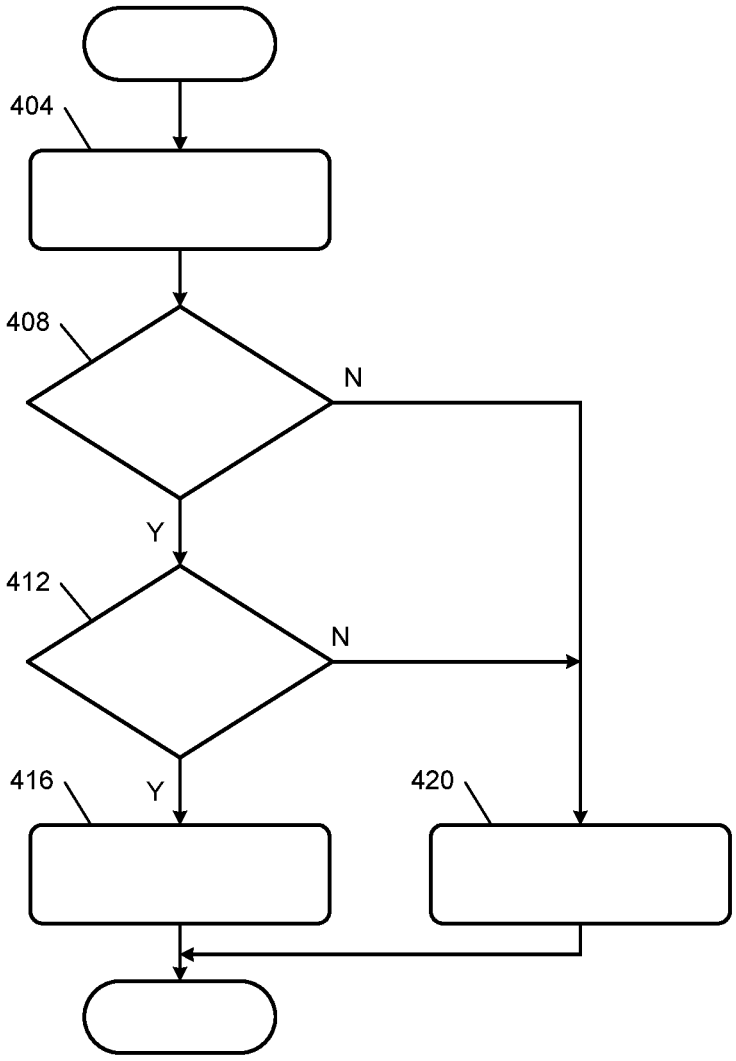
FIG. 4 is a flowchart depicting an example method of controlling fuel flow to a fuel tank to prevent fuel gelling.

FIG. 4 is a flowchart depicting an example method of controlling fuel flow to the fuel tank 116 to prevent fuel gelling. Control begins with 404 where the prediction module 248 determines the predicted value 252. At 408, the regulator control module 204 and/or the fuel control module 208 determine whether the first requested speed 224 is greater than the predetermined speed. The predetermined speed is greater than zero. If 408 is true, control continues with 412. If 408 is false, control transfers to 420.

At 412, the regulator control module and/or the fuel control module 208 determine whether the predicted value 252 is greater than the predetermined value that is greater than zero. If 412 is true, the regulator control module 204 and/or the fuel control module 208 increase warm fuel flow back to the fuel tank 116 to prevent fuel gelling at 416. For example, the regulator control module 204 may increase the opening of the regulator valve 132, thereby increasing a flow rate of warm fuel from the fuel rail 124 back to the fuel tank 116. Additionally or alternatively, the fuel control module 208 may increase a period of application of a voltage to the fuel injectors 128 that is a period less than the predetermined period to open the fuel injectors 128 and greater than zero. This causes the fuel injectors 128 to increase a flow rate of warm fuel from the fuel injectors 128 (and the fuel rail 124) back to the fuel tank 116. If 412 is false, the regulator control module 204 and the fuel control module 208 do not increase warm fuel flow to the fuel tank 116 at 420. While control is shown and discussed as ending, the example of FIG. 4 may be illustrative of one control loop and control may return to 404.

Referring back to FIG. 2, heating and cooling of the DEF injector 140 may cause variations in the amount of DEF injected by the DEF injector 140. In various implementations, the first request module 220 may determine the first requested speed 224 based on maintaining the DEF injector temperature at a vaporization temperature of DEF within the exhaust system.

The first request module 220 may determine an expected amount of heat transfer to the DEF injector 140 from the exhaust system based on, for example, energy of an exhaust pipe through which the DEF injector 140 injects DEF, and the ambient temperature. The first request module 220 may determine an expected change in the DEF injector temperature based on the expected heat transfer to the DEF injector 140, a previous (e.g., last) value of the DEF injector temperature, a present value of the DEF injector temperature, and an expected heat transfer between the DEF injector 140 and the coolant circuit. The first request module 220 may determine the expected heat transfer between the DEF injector 140 and the coolant circuit based on a flow rate of coolant through the coolant circuit and the coolant temperature within the coolant circuit.

The first request module 220 may estimate the DEF injector temperature (e.g., at a tip of the DEF injector 140) based on the present value of the DEF injector temperature and the expected heat transfer to the DEF injector 140. The first request module 220 may set the first requested speed 224 based on a comparison of the DEF injector temperature with the vaporization temperature. For example, the first request module 220 may set the first requested speed 224 to greater than the predetermined speed when the DEF injector temperature is greater than the vaporization temperature.

Additionally or alternatively, the first request module 220 may determine an amount of change in DEF injection based on the expected heat transfer between the DEF injector 140 and the coolant circuit. The amount of change in DEF injection may increase as a change in the expected heat transfer between the DEF injector 140 and the coolant circuit increases and vice versa. When the amount of change in DEF injection is greater than a predetermined amount, the first request module 220 may adjust the first requested speed 224 based on the comparison of the DEF injector temperature and the vaporization temperature.

Figure 5:
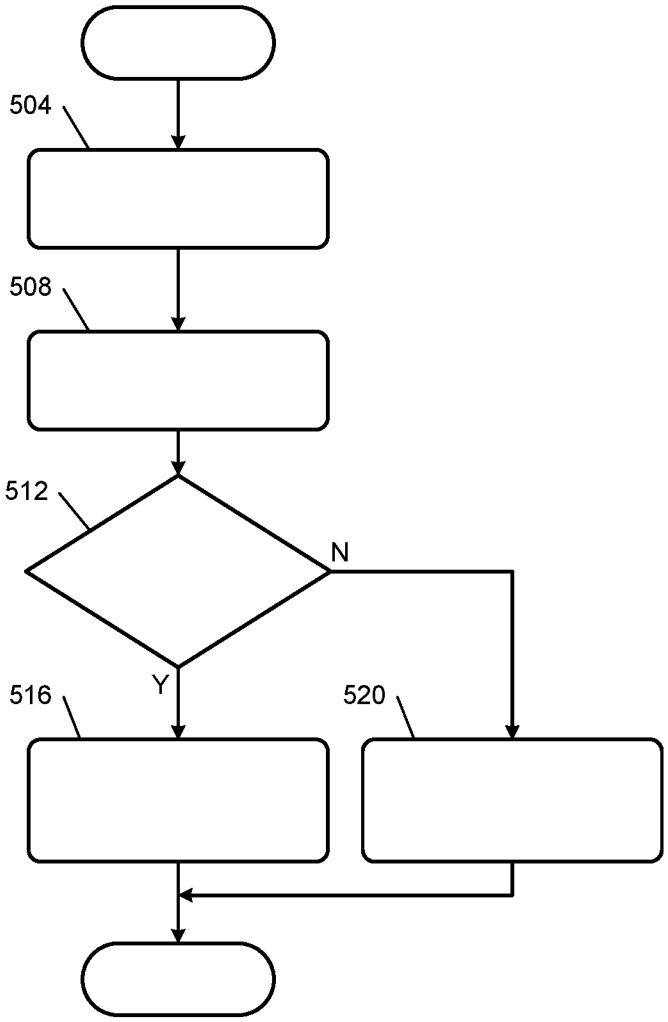
FIG. 5 is a flowchart depicting an example method of setting a requested coolant pump speed to prevent overcooling of a diesel exhaust fluid (DEF) injector and undercooling of the DEF injector.

FIG. 5 includes a flowchart depicting an example method of setting the first requested speed. Control may begin with 504 where the first request module 220 estimates the DEF injector temperature, as described above. At 508, the first request module 220 may determine an expected amount of change in DEF injection due to heat transfer between the DEF injector 140 and the coolant circuit.

At 512, the first request module 220 may determine whether the expected amount of change in DEF injection is greater than the predetermined amount. If 512 is true, the first request module 220 may set the first requested speed 224 based on adjusting (warming or cooling) the DEF temperature toward the vaporization temperature at 516. For example, the first request module 220 may increase the first requested speed 224 when the DEF injector temperature is greater than the vaporization temperature. The first request module 220 may decrease the first requested speed 224 when the DEF injector temperature is less than the vaporization temperature. If 512 is false, the first request module 220 may maintain the first requested speed 224 at 520. While control is shown and discussed as ending, the example of FIG. 5 may be illustrative of one control loop and control may return to 504.

Referring back to FIG. 2, the shutter control module 218 may generally actuate the aerodynamic shutter 168 to the fully closed position when the vehicle speed is greater than a predetermined vehicle speed (e.g., approximately 35 miles per hour or another suitable speed) and a speed of the one or more fans is less than a predetermined fan speed. The shutter control module 218 may open the aerodynamic shutter 168 when at least one of (i) the vehicle speed is less than the predetermined vehicle speed and (ii) the speed of the fan(s) is greater than the predetermined fan speed. In various implementations, duty cycle of a signal applied to the one or more fans to control a speed of the one or more fans may be used in place of the speed of the one or more fans. Generally speaking, the speed of the fan(s) increases as the duty cycle of the signal increases and vice versa.

The speed of the fan(s) is generally increased as the load of the engine 104 increases and vice versa for cooling of the engine 104. The speed of the fan(s) may therefore be greater than the predetermined fan speed, for example, when the vehicle is travelling up a hill and the load of the engine 104 is high. The DEF injector temperature may increase when the load of the engine 104 is high. The first request module 220 may increase the first requested speed 224 based on the DEF injector temperature. Because the speed of the fan(s) is greater than the predetermined fan speed, the shutter control module 218 may open the aerodynamic shutter 168.

When the vehicle reaches a top of the hill and travels downhill, the load of the engine 104 decreases. The speed of the fan(s) may therefore be decreased, and the shutter control module 218 may actuate the aerodynamic shutter 168 to the fully closed position. The fuel temperature, however, may be high when the load of the engine 104 decreases due to the high temperature of the engine 104 itself. Based on the high fuel temperature, the regulator control module 204 may increase the opening of the regulator valve 132 and the second request module 232 may increase the second requested speed 236 to cool the fuel via the fuel heat exchanger 136.

The aerodynamic shutter 168 being in the fully closed position (due to the speed of the fan(s) being less than the predetermined fan speed), enables a first cooling rate of the DEF injector 140 and the fuel, even when the second coolant pump 160 is operating a predetermined maximum speed of the second coolant pump 160. To provide a second cooling rate of the DEF injector 140 and the fuel that is greater than the first cooling rate, the shutter control module 218 opens the aerodynamic shutter 168 (e.g., to the fully open position) when the target speed 244 is equal to the predetermined maximum speed of the second coolant pump 160 and the speed of the fan(s) is less than the predetermined fan speed. Opening the aerodynamic shutter 168 more quickly cools the fuel and the DEF injector 140, despite the low speed of the fan(s).

Figure 6:
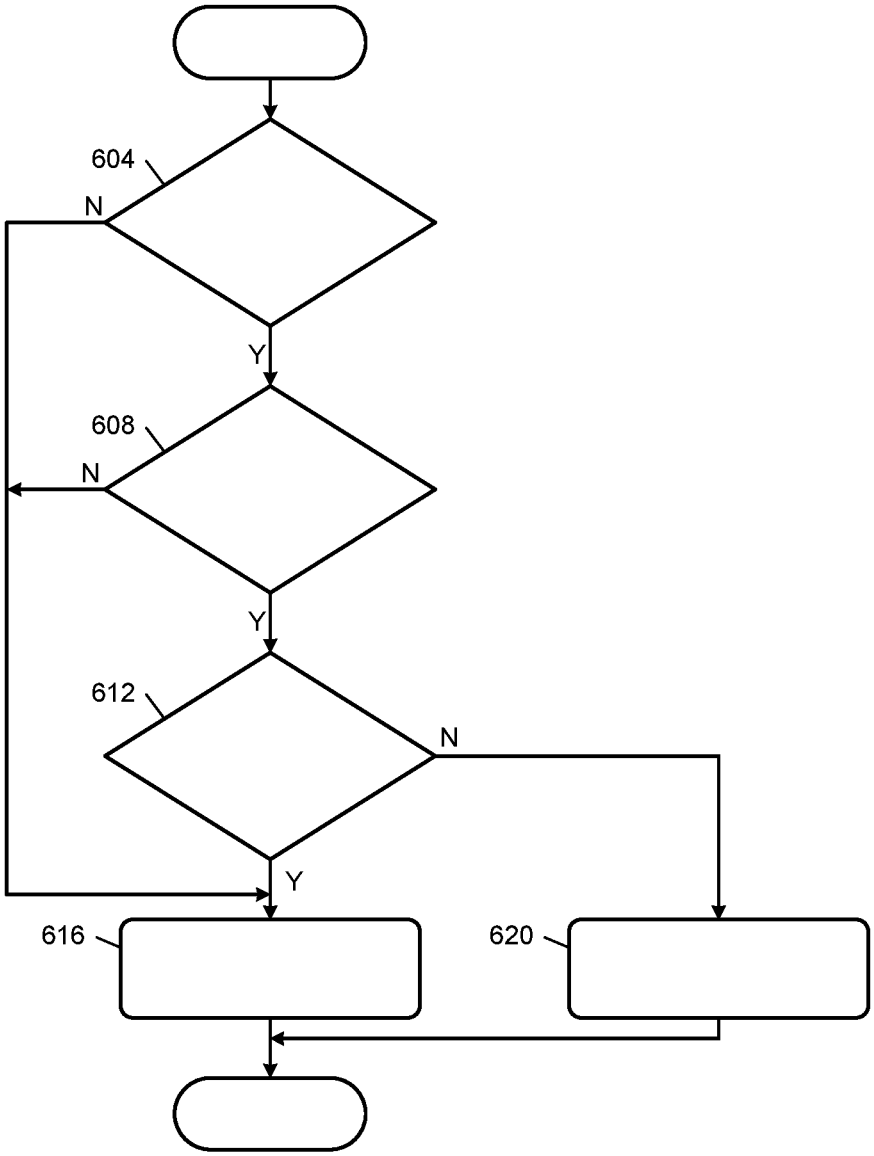
FIG. 6 is a flowchart depicting an example method of controlling actuation of an aerodynamic shutter.

FIG. 6 is a flowchart depicting an example method of controlling opening of the aerodynamic shutter 168. Control begins with 604 where the shutter control module 218 determines whether the vehicle speed is greater than the predetermined speed (e.g., approximately 35 miles per hour). If 604 is true, control continues with 608. If 604 is false, control transfers to 616, which is discussed further below.

At 608, the shutter control module 218 determines whether the speed of the fan(s) is less than the predetermined fan speed. If 608 is true, control continues with 612. If 608 is false, control transfers to 616. At 612, the shutter control module 218 determines whether the target speed 244 of the second coolant pump 160 is equal to the predetermined maximum speed of the second coolant pump 160. If 612 is true, the shutter control module 218 opens the aerodynamic shutter 168 (e.g., to the fully open position or to a position between the fully closed position and the fully open position) at 616. If 612 is false, the shutter control module 218 closes the aerodynamic shutter 168 to the fully closed position at 620. While control is shown and discussed as ending, the example of FIG. 6 may be illustrative of one control loop and control may return to 604.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A coolant control system of a vehicle comprising:

a coolant pump that pumps coolant to a heat exchanger that is different than a radiator of the vehicle;

the heat exchanger;

a diesel exhaust fluid (DEF) injector that injects a DEF into an exhaust system of the vehicle and that receives coolant output from the heat exchanger;

a fuel heat exchanger that receives fuel flowing from a fuel rail to a fuel tank of the vehicle, that receives coolant output from the DEF injector, and that transfers heat between coolant flowing through the fuel heat exchanger and fuel flowing through the fuel heat exchanger, wherein the coolant pump receives coolant output from the fuel heat exchanger; and an engine control module (ECM) configured to:

determine a first requested speed of the coolant pump for DEF injector cooling;

determine a second requested speed of the coolant pump for fuel cooling using the fuel heat exchanger;

determine a target speed of the coolant pump based on the first and second requested speeds;

control a speed of the coolant pump based on the target speed; and based on at least one of the first requested speed and the second requested speed, selectively increase at least one of:

opening of a valve that controls a flow rate of fuel flowing from the fuel rail to the fuel tank;

a flow rate of fuel from fuel injectors of an engine to the fuel tank; and the target speed of the coolant pump, wherein the ECM is configured to, when the first requested speed is greater than or equal to a predetermined speed, selectively increase the opening of the valve that controls the flow rate of fuel flowing from the fuel rail to the fuel tank.

2. The coolant control system of claim 1 wherein the ECM is configured to:

determine a predicted value based on a temperature of the fuel; and when the first requested speed is greater than or equal to the predetermined speed and the predicted value is greater than a predetermined value, increase the opening of the valve that controls the flow rate of fuel flowing from the fuel rail to the fuel tank.

3. The coolant control system of claim 2 wherein the ECM is configured to:

increase the predicted value as the temperature of the fuel decreases; and decrease the predicted value as the temperature of the fuel increases.

4. The coolant control system of claim 1 wherein the ECM is configured to, when the first requested speed is greater than or equal to a predetermined speed, selectively increase the flow rate of fuel from fuel injectors of the engine to the fuel tank.

5. The coolant control system of claim 4 wherein the ECM is configured to:

determine a predicted value based on a temperature of the fuel; and when the first requested speed is greater than or equal to the predetermined speed and the predicted value is greater than a predetermined value, increase the flow rate of fuel from fuel injectors of the engine to the fuel tank.

6. The coolant control system of claim 5 wherein the ECM is configured to:

increase the predicted value as the temperature of the fuel decreases; and decrease the predicted value as the temperature of the fuel increases.

7. The coolant control system of claim 1 wherein the ECM is configured to, when the first requested speed is greater than or equal to a predetermined speed, both:

selectively increase the opening of the valve that controls the flow rate of fuel flowing from the fuel rail to the fuel tank; and increase the flow rate of fuel from fuel injectors of the engine to the fuel tank.

8. The coolant control system of claim 7 wherein the ECM is configured to:

determine a predicted value based on a temperature of the fuel; and when the first requested speed is greater than or equal to the predetermined speed and the predicted value is greater than a predetermined value, both:

selectively increase the opening of the valve that controls the flow rate of fuel flowing from the fuel rail to the fuel tank; and increase the flow rate of fuel from fuel injectors of the engine to the fuel tank.

9. The coolant control system of claim 8 wherein the ECM is configured to:

increase the predicted value as the temperature of the fuel decreases; and decrease the predicted value as the temperature of the fuel increases.

10. The coolant control system of claim 8 wherein the ECM is configured to determine the predicted value further based on a vehicle speed, a temperature of the coolant, a flowrate of the coolant, an ambient temperature, and a position of an aerodynamic shutter.

11. The coolant control system of claim 1 wherein the ECM is further configured to actuate an aerodynamic shutter to an open position when all of:

a speed of a fan that pushes air to the heat exchanger and the radiator is less than a predetermined value;

a speed of the vehicle is greater than a predetermined value; and the target speed of the coolant pump is equal to a predetermined maximum speed of the coolant pump.

12. The coolant control system of claim 11 wherein the ECM is further configured to actuate the aerodynamic shutter to a fully closed position when at least one of:

the speed of the fan is greater than the predetermined value; and the target speed of the coolant pump is less than the predetermined maximum speed.

13. The coolant control system of claim 1 wherein the ECM is configured to selectively set the target speed based on a greater one of the first and second requested speeds.

14. The coolant control system of claim 13 wherein the ECM is configured to:

determine the first requested speed of the coolant pump based on a temperature of the DEF injector; and determine the second requested speed of the coolant pump based on a temperature of the fuel.

15. The coolant control system of claim 14 wherein the ECM is configured to determine the first requested speed of the coolant pump based on a comparison of the temperature of the DEF injector and a vaporization temperature of the DEF.

16. The coolant control system of claim 14 wherein the ECM is configured to determine the first requested speed of the coolant pump further based on an amount of heat transfer from the DEF injector to the coolant.

17. The coolant control system of claim 14 wherein the ECM is configured to determine the first requested speed of the coolant pump further based on an expected change in an amount of DEF injected by the DEF injector based on an amount of heat transfer between the DEF injector and coolant.

18. A coolant control system of a vehicle comprising:

a coolant pump that pumps coolant to a heat exchanger that is different than a radiator of the vehicle;

the heat exchanger;

a diesel exhaust fluid (DEF) injector that injects a DEF into an exhaust system of the vehicle and that receives coolant output from the heat exchanger;

a fuel heat exchanger that receives fuel flowing from a fuel rail to a fuel tank of the vehicle, that receives coolant output from the DEF injector, and that transfers heat between coolant flowing through the fuel heat exchanger and fuel flowing through the fuel heat exchanger, wherein the coolant pump receives coolant output from the fuel heat exchanger; and an engine control module (ECM) configured to:

determine a first requested speed of the coolant pump for DEF injector cooling;

determine a second requested speed of the coolant pump for fuel cooling using the fuel heat exchanger;

determine a target speed of the coolant pump based on the first and second requested speeds;

control a speed of the coolant pump based on the target speed; and based on at least one of the first requested speed and the second requested speed, selectively increase at least one of:

opening of a valve that controls a flow rate of fuel flowing from the fuel rail to the fuel tank;

a flow rate of fuel from fuel injectors of an engine to the fuel tank; and the target speed of the coolant pump, wherein the ECM is configured to, when the first requested speed is greater than or equal to a predetermined speed, both:

selectively increase the opening of the valve that controls the flow rate of fuel flowing from the fuel rail to the fuel tank; and increase the flow rate of fuel from fuel injectors of the engine to the fuel tank.

19. A coolant control system of a vehicle comprising:

a coolant pump that pumps coolant to a heat exchanger that is different than a radiator of the vehicle;

the heat exchanger;

a diesel exhaust fluid (DEF) injector that injects a DEF into an exhaust system of the vehicle and that receives coolant output from the heat exchanger;

a fuel heat exchanger that receives fuel flowing from a fuel rail to a fuel tank of the vehicle, that receives coolant output from the DEF injector, and that transfers heat between coolant flowing through the fuel heat exchanger and fuel flowing through the fuel heat exchanger, wherein the coolant pump receives coolant output from the fuel heat exchanger; and an engine control module (ECM) configured to:

determine a first requested speed of the coolant pump for DEF injector cooling;

determine a second requested speed of the coolant pump for fuel cooling using the fuel heat exchanger;

determine a target speed of the coolant pump based on the first and second requested speeds;

control a speed of the coolant pump based on the target speed; and based on at least one of the first requested speed and the second requested speed, selectively increase at least one of:

opening of a valve that controls a flow rate of fuel flowing from the fuel rail to the fuel tank;

a flow rate of fuel from fuel injectors of an engine to the fuel tank; and the target speed of the coolant pump, wherein the ECM is further configured to actuate an aerodynamic shutter to an open position when all of:

a speed of a fan that pushes air to the heat exchanger and the radiator is less than a predetermined value;

a speed of the vehicle is greater than a predetermined value; and the target speed of the coolant pump is equal to a predetermined maximum speed of the coolant pump.

* * * * *